United States Patent [19]

Phillips

[11] Patent Number: 4,707,409

[45] Date of Patent: Nov. 17, 1987

[54] SPINNERET ORIFICES AND FOUR-WING FILAMENT CROSS-SECTIONS THEREFROM

[75] Inventor: Bobby M. Phillips, Kingsport, Tenn.

[73] Assignee: Eastman Kodak Company, Rochester, N.Y.

[21] Appl. No.: 890,270

[22] Filed: Jul. 29, 1986

[51] Int. Cl.[4] ..... D02G 3/00

[52] U.S. Cl. ..... 428/397; 428/364; 428/373; 428/374; 57/243; 57/246; 57/248

[58] Field of Search ..... 458/397, 364, 373, 374; 57/243, 246, 248

[56] References Cited

U.S. PATENT DOCUMENTS

| | | | |
|---|---|---|---|
| 4,245,001 | 1/1981 | Phillips et al. | 428/397 |
| 4,408,977 | 10/1983 | Phillips | 428/397 |
| 4,472,477 | 9/1984 | Phillips | 428/397 |

*Primary Examiner*—Lorraine T. Kendell
*Assistant Examiner*—S. A. Gibson
*Attorney, Agent, or Firm*—Malcolm G. Dunn; William P. Heath, Jr.

[57] ABSTRACT

Spinneret having an orifice defined by two intersecting slots and each intersecting slot in turn defined by three quadrilateral sections connected in series: the middle quadrilateral section of each intersecting slot having a greater width than the other two quadrilateral sections of the same intersecting slot and intersecting the other intersecting slot at its middle quadrilateral section to form therewith a generally X-shaped opening, with each of the other two quadrilateral sections of each intersecting slot being longer than the middle quadrilateral section of each intersecting slot; and a four-winged filament cross-section extruded through the aforedescribed spinneret orifice.

4 Claims, 15 Drawing Figures

SPINNERET ORIFICES AND FOUR-WING FILAMENT CROSS-SECTIONS THEREFROM

The present invention is directed to novel cross-sectioned orifices in spinnerets, the orifices being useful for extruding therethrough four-wing cross-sections, and to four-wing filament cross-sections spun from the novel cross-sectioned orifices of such spinnerets. The resulting filaments offer improved fracturability, increased bulk, and a preferred bending direction over previous four-wing filament cross-sections, and in nonfractured yarns and tows increased liquid retention capabilities.

Spinneret orifice cross-sections of the prior art have been used to extrude two-wing, three-wing and four-wing filament cross-sections. See, for instance, U.S. Pat. No. 4,245,001 for examples of two-wing, three-wing and four-wing filament cross-sections. The filament cross-sections in the latter patent are also fracturable. Also see U.S. Pat. No. 4,472,477 for other fracturable filament cross-sections and particularly note FIG. 57 and FIG. 58 for examples, respectively, of a spinneret orifice and a four-wing filament cross-section (as spun from the spinneret orifice of FIG. 57).

DISCLOSURE OF INVENTION

In accordance with the present invention, I provide a spinneret having an orifice defined by two intersecting slots. Each intersecting slot in the spinneret is defined by three quadrilaterial sections connected in series. Each quadrilateral section has two parallel sides extending along the length of the quadrilateral section and is connected at one end thereof to one end of one of the other quadrilateral sections at an angle less than 180°. Each middle quadrilateral section of an intersecting slot has a greater width than the other two quadrilateral sections of the same intersecting slot and intersects the other intersecting slot at its middle quadrilateral section to form therewith a generally X-shaped opening. Each of the other two quadrilateral sections of each intersecting slot is longer than the middle quadrilateral section of each intersecting slot, and has formed at its free extremity an enlarged tip, the greatest dimension of which is equal to $D_1$. In the structure defined thus far, the greatest distance along any of the intersecting slots from the intersection of the two intersecting slots through the center of the quadrilateral sections to the center of one of the enlarged tips formed at the aforementioned free extremity equals $L_1$; the greater distance between the two opposing intersections of the two middle quadrilateral sections with the corresponding quadrilateral sections on the same side of the intersection of the intersecting slots equals $D_2$; and the greater distance between the centers of the enlarged tips formed at the aforementioned free extremities on the same side of the intersections of the intersecting slots equals $D_3$; so that $$L/D_2 \geqq 2 \text{ and } L/D_3 \geqq 2.$$

The spinneret orifice has a major axis extending generally along the length thereof and through the intersection of the two intersecting slots and has a minor axis extending generally across the width of the orifice and through the intersection of the two intersecting slots. The distance between the centers of the enlarged tips on each side of the minor axis is equal to Z. The distance between the centers of the enlarged tips on each of the same sides of the major axis is equal to T. The width of each of the aforementioned other two quadrilaterals of each intersecting slot is equal to W. The width of each middle quadrilateral section of each intersecting slot is equal to C. The angle of intersection of the two intersecting slots on each side of the minor axis is equal to Θ. In the structure defined, thereof, $T/W \geqq 2$ and C/W is between 1 and 1.8, Θ is equal from about 45° to about 135°, and $D_1$ is equal to 2W.

In the orifice of the spinneret,

W may be 0.084 millimeter
C may be 1.4W
Θ may be 90°
Z may be 6W
T may be 33W;

or

W may be 0.084 millimeter
C may be 1.4W
Θ may be 90°
Z may be 8W
T may be 27W;

or

W may be 0.084 millimeter
C may be 1.2W
Θ may be 90°
Z may be 6W
T may be 27W.

In the orifice of the spinneret, each of the aforementioned other two quadrilateral sections of each intersecting slot may form an angle with the middle quadrilateral section of the same intersecting slot of greater than 90° but less than 180°.

Each of the intersecting slots may intersect at the middle of the middle quadrilateral section of the other intersecting slot, or may intersect the middle quadrilateral section of the other intersecting slot at a location other than the middle thereof. One of the middle quadrilateral sections of an intersecting slot may be longer than the middle quadrilateral section of the other intersecting slot.

Also, in accordance with the present invention, I provide a continuous filament having a continuous body section extending along the length thereof and two pairs of wing members extending from and along the length of the continuous body section. The continuous filament has a cross-section wherein the continuous body section is defined by a central body, and each aforementioned pair of wing members projects like rabbit ears from one side of the central body and at an opposite side from the projection of the other pair of wing members. The central body may comprise about 15 to about 60% of the total mass of the continuous filament and the two pairs of wing members may comprise about 85 to about 40% of the total mass of the continuous filament.

The central body defines its peripheral surface between the wing members of each pair of the aforementioned wing members a first concave curvature.

The wing members of each pair of wing members may diverge away from each other, or may converge toward each other.

The central body defines along its peripheral surface on other sides thereof opposite from each other and between each of the pairs of wing members a second concave curvature having a greater radius of curvature than the aforementioned first concave curvature. Each of the second concave curvatures may include concave curvatures that are smaller than the first concave curvature.

BRIEF DESCRIPTION OF DRAWINGS

The details of my invention will be described in connection with the accompanying drawings in which.

BEST MODE FOR CARRYING OUT THE INVENTION

The novel orifice of the spinneret disclosed herein may, of course, be used to extrude therethrough any polymer capable of being spun into filaments. Some useful polymers, to mention a few, include poly(ethylene terephthalate), poly(1,4-cyclohexylenedimethylene terephthalate), poly(butylene terephthalate), polypropylene, nylon, and derivatives of cellulose such as organic esters of cellulose (diacetate and triacetate, for example) and rayon.

The novel filament having a four-wing cross-section, as disclosed herein, and resulting from being extruded from the orifice of the spinneret mentioned above can be used for any suitable purpose, such as in textile yarns, continuous and staple-length, and in filters for whatever purpose including tobacco smoke filters for cigarettes. In a textile use, for example, the filaments may be fractured in a manner similar to that disclosed in the aforementioned U.S. Pat. Nos. 4,245,001 and 4,472,477, or may be used in a nonfractured form.

Figure 1:
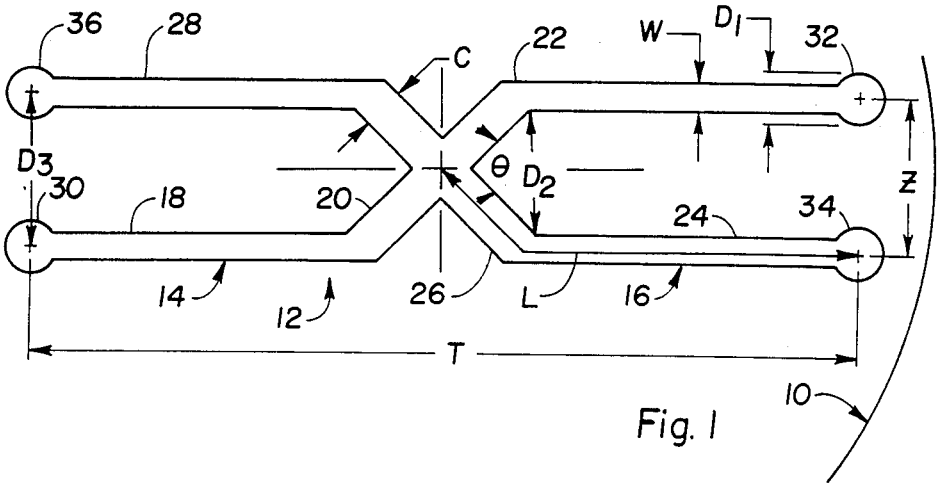
FIG. 1 is a diagrammatic illustration of part of a spinneret and a spinneret orifice within the spinneret.

In reference, therefore, to the drawings and initially to FIG. 1, a portion of a spinneret is shown at 10 and the spinneret orifice formed in the spinneret is shown at 12. The spinneret orifice is defined by two intersecting slots 14, 16. Intersecting slot 14 has three quadrilateral sections 18, 20 and 22 connected in series, and intersecting slot 16 also has three quadrilateral sections 24, 26 and 28 connected in series. A quadrilateral, for purposes of this description, is a plane figure bounded by four straight lines and having four interior angles. It should be understood that if a straight line were to be drawn across the width of a quadrilateral section at its connection with another quadrilateral section, it would form one of the four straight lines of such "quadrilateral" as defined. Although a "plane figure" is mentioned in this definition, it should also be understood that the spinneret orifice, as made up of these quadrilateral sections, will also have some depth through the surface of the spinneret.

Each quadrilateral section (18, 20, 22, 24, 26, 28) has two parallel sides extending along the length of the quadrilateral section and is connected at one end thereof to one end of one of the other quadrilateral sections at an angle less than 180°.

Each middle quadrilateral section (20, 26) of an intersecting slot (14, 16) has a greater width than the other two quadrilateral sections of the same intersecting slot, and intersects the other intersecting slot at its middle quadrilateral section to form therewith a generally X-shaped opening, as may be observed by viewing the two crossed middle quadrilateral sections 20, 26 in FIG. 1. Each of the other two quadrilateral sections (18, 22) and (24, 28) of each intersecting slot (14, 16) is longer than the middle quadrilateral section of each intersecting slot, and has formed at its free extremity an enlarged tip (30, 32, 34, 36 for the respective quadrilateral sections). The greatest dimension of the enlarged tip is equal to $D_1$. The enlarged tip is preferably circular, but may also be rectangular, square, diamond-shaped or oval, so long as the longer dimension of the non-circular embodiment is approximately perpendicular to the length of the slot. See for instance U.S. Pat. No. 2,945,739 (Lehmicke) for illustrations of these different shaped enlarged tips.

Since the spinneret orifice, as will become apparent from the other drawing figures and from the description herein, may take various configurations by changes in size of the different quadrilateral sections and angle of projection, the greatest distance along any of the intersecting slots from the intersection of the two intersecting slots (14, 16) through the center of the quadrilateral sections to the center of the enlarged tip formed at a free extremity will equal L. The greater distance between the two opposing intersections of the two middle quadrilateral sections with the corresponding quadrilateral sections on the same side of the intersection of the intersecting slots will equal $D_2$. The greater distance between the centers of the enlarged tips formed at the free extremities on the same side of the intersection of the intersecting slots will equal $D_3$. In this manner $$L/D_2 \geqq 2 \text{ and } L/D_3 \geqq 2.$$

In the spinneret orifice illustrated in FIG. 1, the major axis of the orifice extends generally along the length of the orifice and through the intersection of the two intersecting slots (14, 16). The minor axis of the orifice extends generally across the width of the orifice and through the intersection of the two intersecting slots (14, 16).

In FIG. 1, the distance between the centers of the enlarged tips on each side of the aforementioned minor axis is equal to Z. The distance between the centers of the enlarged tips on each of the same sides of the aforementioned major axis is equal to T. The width of each of the aforementioned other two quadrilaterals (18, 22; and 24, 26) of each intersecting slot (14, 16) is equal to W. The width of each middle quadrilateral section (20, 26) of each intersecting slot (14, 16) is equal to C. The angle of intersection of the two intersecting slots (14, 16) on each side of the aforementioned minor axis is equal to Θ. In this manner, therefore, $T/W \geqq 3$ and C/W is between 1 and 1.8, Θ is equal to from about 45° to about 135°, and $D_1$ is equal to 2W. W is preferably 0.84 millimeter.

A spinneret orifice may thus have the following dimensions, for example:

W=0.084 millimeter
C=1.4W
Θ=90°
Z=6W
T=33W, or

W=0.84 millimeter
C=1.4W
Θ=90°
Z=8W
T=27W or

W=0.84 millimeter
C=1.2W
Θ=90°
Z=6W
T=27W

Each of the aforementioned other two quadrilateral sections (18, 22; and 24, 28) of each intersecting slot (14, 16) may form an angle with the middle quadrilateral section of the same intersecting slot of greater than 90° but less than 180°.

Each of the intersecting slots (14, 16) may intersect at the middle of the middle quadrilateral section of the other intersecting slot, or at a location in the middle quadrilateral section of the other intersecting slot other than the middle thereof. One of the middle quadrilateral sections of an intersecting slot may be longer than the middle quadrilateral section of the other intersecting slot and/or wider.

Figure 6:
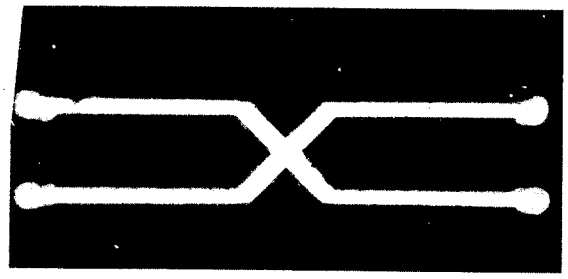
FIG. 6 is a microphotograph of still a different spinneret orifice.
Figure 4:
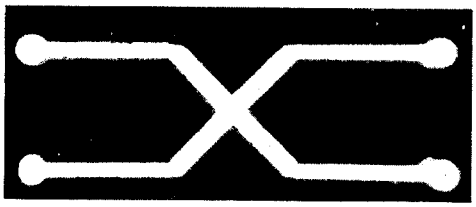
FIG. 4 is a microphotograph of another spinneret orifice.
Figure 2:
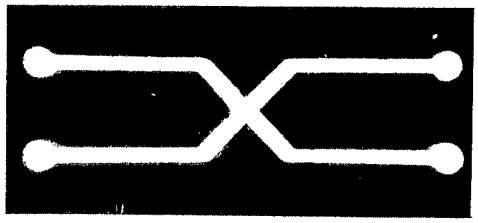
FIG. 2 is a microphotograph of a spinneret orifice.

FIGS. 2, 4 and 6 are photographic illustrations of the spinneret orifice of FIG. 1, each having at least one dimension different from the corresponding dimension in the other spinneret orifices. Using the designated dimensions from FIG. 1, the dimensions for the respective spinneret orifices are as follows:

| | FIG. 2 | FIG. 4 | FIG. 6 |
|---|---|---|---|
| W = | .084 mm | .084 mm | .084 mm |
| C = | 1.4 W | 1.4 W | 1.2 W |
| θ = | 90° | 90° | 90° |
| $D_1$ | 2 W | 2 W | 2 W |
| T = | 33 W | 27 W | 27 W |
| Z = | 6 W | 8 W | 6 W |

Figure 7:
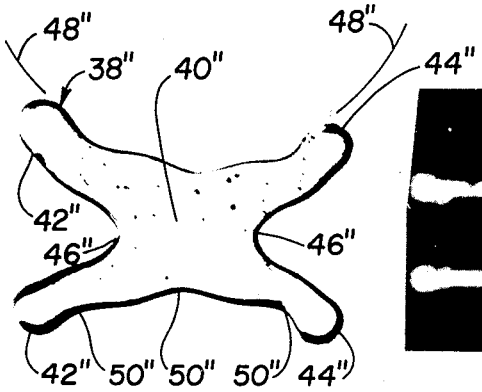
FIG. 7 is a microphotograph of a filament cross-section spun from the spinneret orifice shown in FIG. 6.
Figure 5:
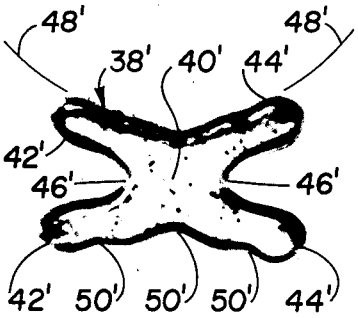
FIG. 5 is a microphotograph of a filament cross-section spun from the spinneret orifice shown in FIG. 4.
Figure 3:
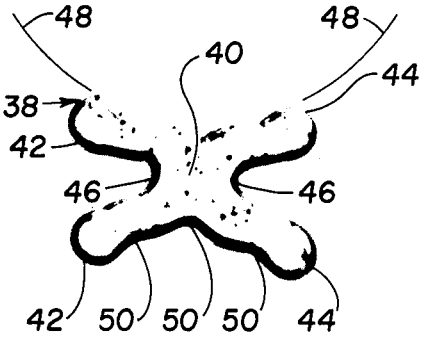
FIG. 3 is a microphotograph of a filament cross-section spun from the spinneret orifice shown in FIG. 2.

In reference to FIGS. 3, 5 and 7, the filament cross-sections illustrated therein were spun, respectively, through the spinneret orifices shown in FIGS. 2, 4 and 6. Each filament has a continuous body section extending along the length thereof and two pairs of wing members extending from and along the length of the continuous body section. In reference, therefore, to FIG. 3, as being representative of the filament cross-sections shown in FIGS. 5 and 7, the continuous filament has a cross-section designated generally 38 wherein the continuous body section is defined by a central body 40, and each pair of wing members 42, 44 projects like rabbit ears from one side of the central body and at an opposite side from the projection of the other pair of wing members. As heretofore mentioned, the central body 40 may comprise about 15 to about 60% of the total mass of the continuous filament, and the two pairs of wing members 42, 44 may comprise about 85 to about 40% of the total mass of the continuous filament.

The central body 40 defines along its peripheral surface between the wing members of each pair of wing members a first concave curvature 46, and defines along its peripheral surface on the other sides of the central body opposite from each other and between each of the pairs of wing members a second concave curvature 48. The second concave curvature has a greater radius of curvature than the first concave curvature because it extends from the tip of one wing member to the tip of the wing member at the opposite end thereof and on the same side of the filament cross-section. Each of the second concave curvatures may include concave curvatures 50 that are smaller than the first concave curvature 46.

The filament cross-sections shown in FIGS. 5 and 7 correspond in structure to the structure described in FIG. 3 and therefore the reference numbers used are the same used in FIG. 3 except being primed (FIG. 5) and double primed (FIG. 7) to show that they are different filament cross-sections.

Figure 8:
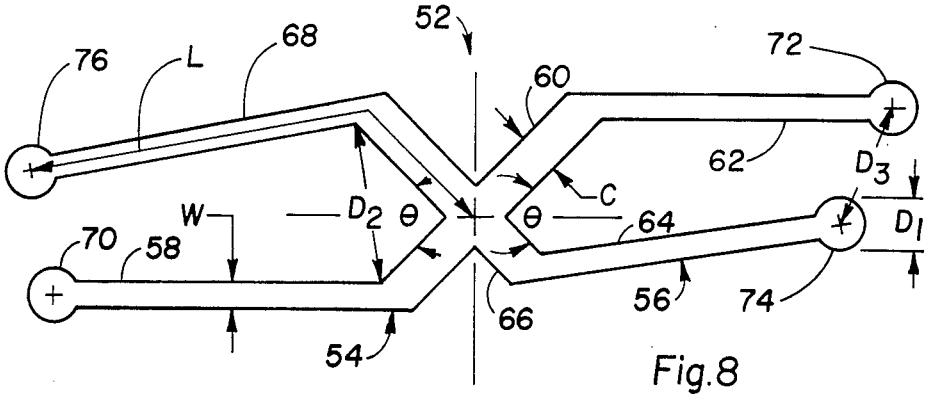
FIG. 8 is a diagrammatic illustration of a further different spinneret orifice.

FIG. 8 illustrates a different embodiment of a spinneret orifice 52 defined by two intersecting slots 54, 56. Intersecting slot 54 has three quadrilateral sections 58, 60, 62 connected in series, and intersecting slot 56 also has three quadrilateral sections 64, 66, 68 connected in series.

Each middle quadrilateral section (60, 66) of an intersecting slot (54, 56) in FIG. 8 has a normalized width C of 2 units, which is greater than the normalized 1 unit width W of each of the other two quadrilateral sections of the same intersecting slot. An enlarged tip 70, 72, 74, 76 is formed at the respective free extremities of the two intersecting slots, wherein $D_1$ is a normalized width of 2 units for the greater dimension of each enlarged tip. The greatest distance L along any of the intersecting slots from the intersection of the two intersecting slots through the center of the quadrilateral sections to the center of one of the enlarged tips is a normalized 15 units. The greater distance $D_2$ between the two opposing intersections of the two middle quadrilateral sections with the corresponding quadrilateral sections on the same side of the intersection of the intersecting slots is a normalized 7 units. The greater distance $D_3$ between the centers of the enlarged tips formed at the free extremities on the same side of the intersection of the two intersecting slots is a normalized 5 units. The angle Θ of intersection of the two intersecting slots on each side of a minor axis extending through the intersection of the intersecting slots is 90°.

Figure 9:
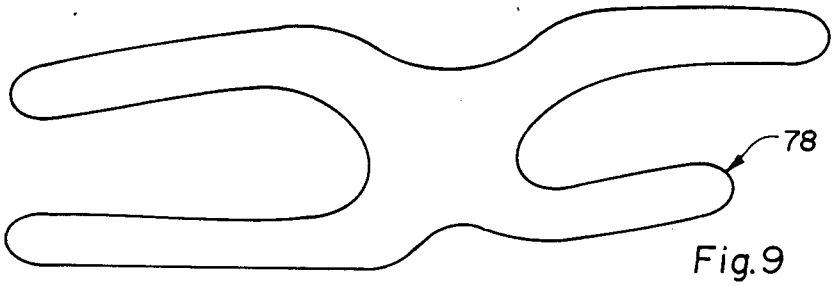
FIG. 9 is an approximation of the configuration of a filament cross-section that could be spun from the spinneret orifice illustrated in FIG. 8.

In FIG. 9, the filament cross-section 78 illustrated represents approximately what would result in being extruded from the spinneret orifice 52 shown in FIG. 8.

Figure 10:
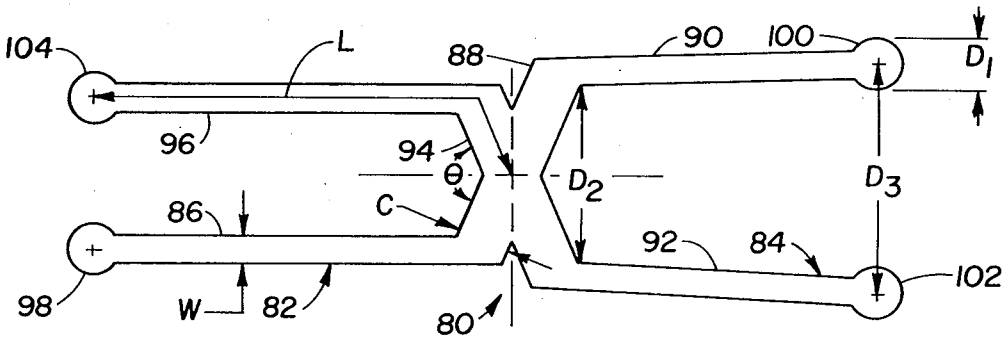
FIG. 10 is a diagrammatic illustration of a still further different spinneret orifice.

FIG. 10 illustrates another different embodiment of a spinneret orifice 80 defined by two intersecting slots 82, 84. Intersecting slot 82 has three quadrilateral sections 86, 88, 90 connected in series, and intersecting slot 84 also has three quadrilateral sections 92, 94, 96 connected in series.

Each middle quadrilateral section (88, 94) of an intersecting slot (82, 84) in FIG. 10 has a normalized width C of 2 units, which is greater than the normalized 1 unit width W of each of the other two quadrilateral sections of the same intersecting slot. An enlarged tip 98, 100, 102, 104 is formed at the respective free extremities of the two intersecting slots, wherein $D_1$ is a normalized width of 2 units for the greatest dimension of each enlarged tip. The greatest distance L along any of the intersecting slots from the intersection of the two intersecting slots through the center of the quadrilateral sections to the center of one of the enlarged tips is a normalized 15 units. The greater distance $D_2$ between the two opposing intersections of the two middle quadrilateral sections with the corresponding quadrilateral sections on the same side of the intersection of the intersecting slots is a normalized 7 units. The greater distance $D_3$ between the centers of the enlarged tips formed at the free extremities on the same side of the intersection of the two intersecting slots is a normalized 7 units. The angle Θ of intersection of the two intersecting slots on each side of a minor axis extending through the intersection of the intersecting slots is 135°.

Figure 11:
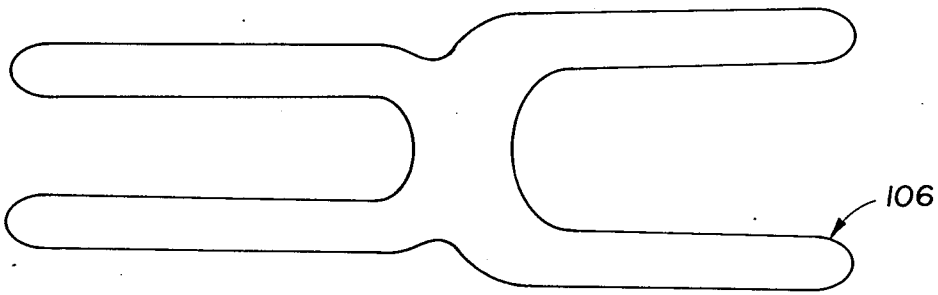
FIG. 11 is an approximation of the configuration of a filament cross-section that could be spun from the spinneret orifice illustrated in FIG. 10.

In FIG. 11, the filament cross-section 106 illustrated represents approximately what would result in being extruded from the spinneret orifice 80 shown in FIG. 10.

Figure 12:
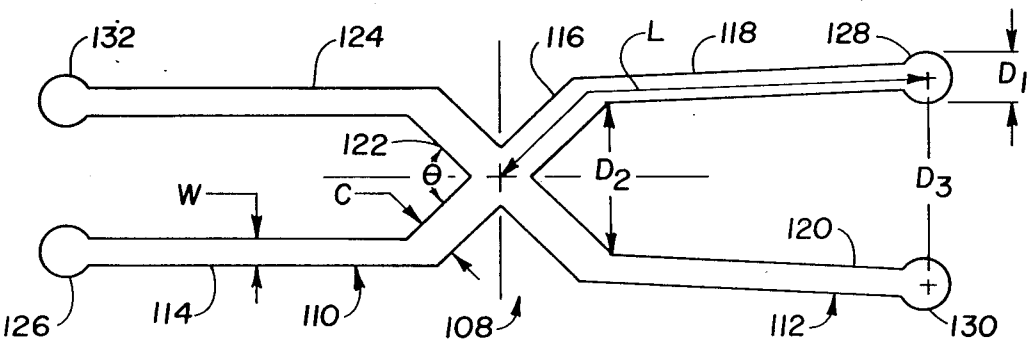
FIG. 12 is a diagrammatic illustration of another embodiment of a spinneret orifice.

FIG. 12 illustrates still a different embodiment of a spinneret orifice 108 defined by two intersecting slots 110, 112. Intersecting slot 110 has three quadrilateral sections 114, 116, 118 connected in series, and intersecting slot 112 also has three quadrilateral sections 120, 122, 124 connected in series.

Middle quadrilateral section 116 in FIG. 12 has a normalized width C of 3 units, and middle quadrilateral section 122 has a normalized width C of 2 units, each of which being greater than the normalized 1 unit width W of each of the other two quadrilateral sections of the same intersecting slot. An enlarged tip 126, 128, 130, 132 is formed at the respective free extremities of the two intersecting slots, wherein $D_1$ is a normalized width of 2 units for the greatest dimension of each enlarged tip. The greater distance L along any of the intersecting slots from the intersection of the two intersecting slots through the center of the quadrilateral sections to the center of one of the enlarged tips is a normalized 15 units. The greater distance $D_2$ between the two opposing intersections of the two middle quadrilateral sections with the corresponding quadrilateral sections on the same side of the intersection of the intersecting slots is a normalized 6 units. The greater distance $D_3$ between the centers of the enlarged tips formed at the free extremities on the same side of the intersection of the two intersecting slots is a normalized 6 units. The angle Θ of intersection of the two intersecting slots on each side of a minor axis extending through the intersection of the intersecting slot is 90°.

Figure 13:
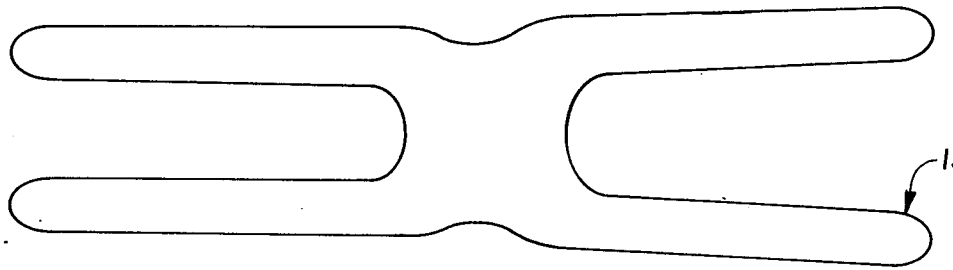
FIG. 13 is an approximation of the configuration of a filament cross-section that could be spun from the spinneret orifice illustrated in FIG. 12.

In FIG. 13, the filament cross-section 134 illustrated represents approximately what would result in being extruded from the spinneret orifice 108 shown in FIG. 12.

Figure 14:
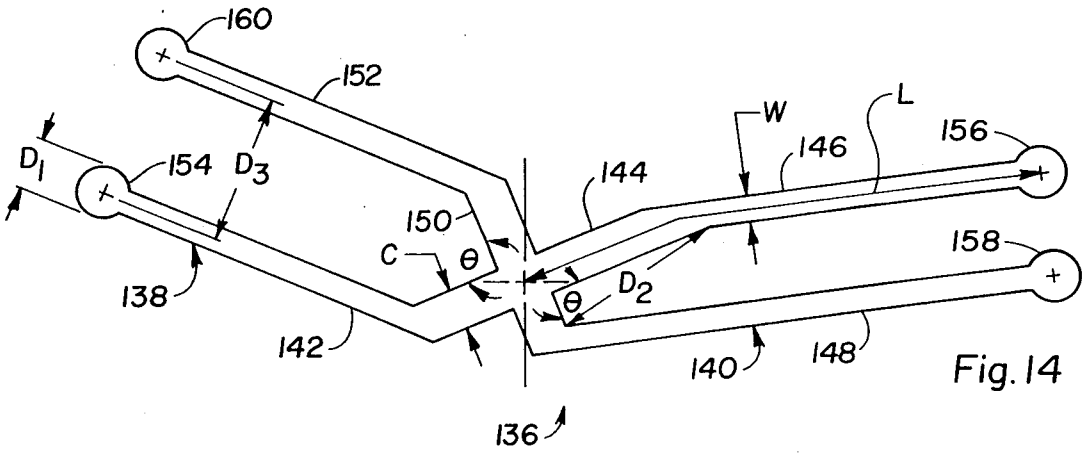
FIG. 14 is a diagrammatic illustration of still another embodiment of a spinneret orifice.

FIG. 14 illustrates a further different embodiment of a spinneret orifice 136 defined by two intersecting slots 138, 140. Intersecting slot 138 has three quadrilateral sections 142, 144, 146 connected in series, and intersecting slot 140 also has three quadrilateral sections 148, 150, 152 connected in series.

Each middle quadrilateral section (144, 150) of an intersecting slot (138, 140) in FIG. 14 has a normalized width C of 2 units, which is greater than the normalized 1 unit width W of each of the other two quadrilateral sections of the same intersecting slot. An enlarged tip 154, 156, 158, 160 is formed at the respective free extremities of the two intersecting slots, wherein $D_1$ is a normalized width of 2 units for the greatest dimension of each enlarged tip. The greater distance L along any of the intersecting slots from the intersection of the two intersecting slots through the center of the quadrilateral sections to the center of one of the enlarged tips is a normalized 15 units. The greater distance $D_2$ between the two opposing intersections of the two middle quadrilateral sections with the corresponding quadrilateral sections on the same side of the intersection of the intersecting slots is a normalized 7 units. The greater distance $D_3$ between the centers of the enlarged tips formed at the free extremities on the same side of the intersection of the two intersecting slots is a normalized 4 units. The angle Θ of intersection of the two intersecting slots on each side of a minor axis extending through the intersection of the intersecting slots is 90°. The angle that the portion of the two intersecting slots on one side of the center of such intersection makes with the portion of the two intersecting slots on the other side of such center may vary from about 120° to about 180°.

Figure 15:
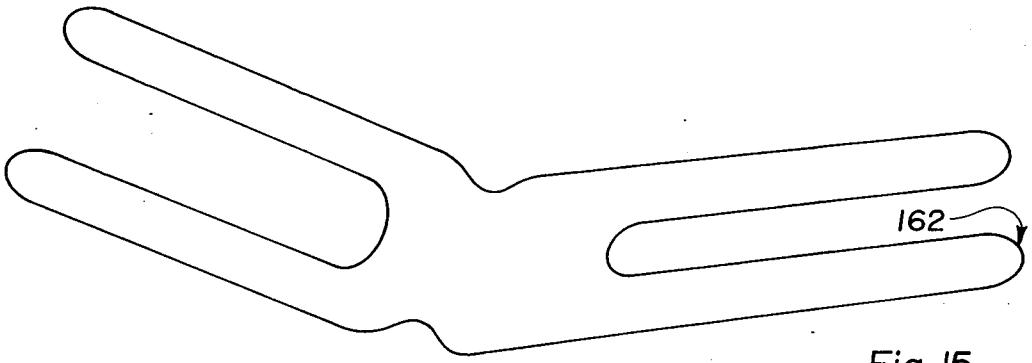
FIG. 15 is an approximation of the configuration of a filament cross-section that could be spun from the spinneret orifice illustrated in FIG. 14.

In FIG. 15, the filament cross-section 162 illustrated represents approximately what would result in being extruded from the spinneret orifice 136 shown in FIG. 14.

The filament cross-sections disclosed herein are, of course, nonround cross-sections. In general, it is well-known in the art that the preservation of nonround cross-sections is dependent, among other things, upon the viscosity-surface tension properties of the melt (when melts are involved) emerging from a spinneret orifice. The quenching of the filament (as in melt spinning) must be such as to preserve the required cross-section. It is also well-known that the higher the inherent viscosity (I.V.) within a given polymer type, the better the shape of the spinneret orifice is preserved in the as-spun filament.

If the disclosed filament cross-section undergoes a fracturing process such as described in the aforementioned U.S. Pat. No. 4,245,001, the versatility of the resulting yarn will be increased. For example, a yarn with high strength, high frequency of protruding ends, short mean protruding end length with a medium bulk can be made and used to give improved aesthetics in printed goods when compared to goods made from conventional false twist textured yarn. On the other hand, a yarn with medium strength, high frequency of protruding ends with medium to long protruding end length and high bulk can be made and used to give desirable aesthetics in jersey knit fabrics for underwear or for women's outerwear. The filament cross-section disclosed herein would intermittently be fractured in an air jet to produce free-protruding ends, with the fracturing occurring at the location of the intersection of the wings with the central body of the continuous body section.

The aforementioned versatility may be achieved primarily by manipulating the fracturing jet pressure and the specific cross-section of the filament. In general, increasing the fracturing jet pressure increases the specific volume and decreases the strength of the yarn. Yarn strength will increase with a greater central body cross-section and yarn specific volume increases with a decreasing central body cross-section.

A major advantage of yarns made according to this invention, when fractured and when compared to staple yarns, is their uniformity along their length. This property translates into excellent knittability and weavability with the added advantage that visually uniform fabrics can be produced which possess distinctively staple-like characteristics.

The aforementioned preferred bending direction is applicable when the filament cross-sections disclosed herein are fractured, and the bending direction is of a wing of each pair toward the other wing of the same pair as a consequence of the presence of the aforedescribed first concave curvature between each pair of wing members.

If the filament cross-section is used in a nonfractured form, liquid will be retained more readily between the wing members of each pair of wing members. This is useful not only for moisture wicking action in textile fabrics, but also for purposes of use in filter constructions. The wing members also serve filtration trapping functions in a cigarette filter construction.

The following is an example included merely for purposes of illustration and is not intended to limit the scope of the invention.

EXAMPLE

The filaments shown in FIGS. 3, 5 and 7 were made using the following equipment and process conditions.

The basic unit of the spinning system design can be subdivided into an extrusion section, a spin block section, a quench section and a take-up section. A brief description of these sections follows.

The extrusion section of the system consists of a vertically mounted screw extruder with a 28:1 L/D screw 2½ inches in diameter. The extruder is fed from a hopper containing polymer which has been dried in a previous separate drying operation to a moisture level ≦0.003 weight percent. Pellet poly(ethylene terephthalate) (PET) polymer (0.64 I.V.) containing 0.3% $TiO_2$ and 0.9% diethylene glycol (DEG) enters the feed port of the screw where it is heated and melted as it is conveyed vertically downward. The extruder has four heating zones of about equal length which are controlled, starting at the feed end at a temperature of 280°, 285°, 285°, 280° C. These temperatures are measured by platinum resistance temperature sensors Model No. 1847-6-1 manufactured by Weed. The rotational speed of the screw is controlled to maintain a constant pressure in the melt (2100 psi) as it exits from the screw into the spin block. The pressure is measured by use of an electronic pressure transmitter [Taylor Model 1347.TF11334(158)]. The temperature at the entrance to the block is measured by a platinum resistance temperature sensor Model No. 1847-6-1 manufactured by Weed.

The spin block of the system consists of a 304 stainless steel shell containing a distribution system for conveying the polymer melt from the exit of the screw extruder to eight dual position spin packs. The stainless steel shell is filled with a Dowtherm liquid/vapor system for maintaining precise temperature control of the polymer melt at the desired spinning temperature of 280° C. The temperature of the Dowtherm liquid/vapor system is controlled by sensing the vapor temperature and using this signal to control the external Dowtherm heater. The Dowtherm liquid temperature is sensed but is not used for control purposes.

Mounted in the block above each dual position pack are two gear pumps. These pumps meter the melt flow into the spin pack assemblies and their speed is precisely maintained by an inverter controlled drive system. The spin pack assembly consists of a flanged cylindrical stainless steel housing (198 mm. in diameter, 102 mm. high) containing two circular cavities of 78 mm. inside diameter. In the bottom of each cavity, a spinneret, as shown in FIGS. 2, 4, 6, is placed followed by 300 mesh circular screen, and a breaker plate for flow distribution. Above the breaker plate is located a 300 mesh screen followed by a 20 mm. bed of sand (e.g. 20/40 to 80/100 mesh layers) for filtration. A stainless steel top with an entry port is provided for each cavity. The spin pack assemblies are bolted to the block using an aluminum gasket to obtain a no-leak seal. The pressure and temperature of the polymer melt are measured at the entrance to the pack (126 mm. above the spinneret exit). The spinneret used is that shown in FIGS. 2, 4, and 6.

The quench section of the melt spinning system is described in U.S. Pat. No. 3,669,584. The quench section consists of a delayed quench zone near the spinneret separated from the main quench cabinet by a removable shutter with circular openings for passage of the yarn bundle. The delayed quench zone extends to approximately 2 3/16" below the spinneret. Below the shutter is a quench cabinet provided with means for applying force convected cross-flow air to the cooling and attenuating filaments. The quench cabinet is approximately 40½" tall by 10½" wide by 14½" deep. Cross-flow air enters from the rear of the quench cabinet at a rate of 160 SCFM. The quench air is conditioned to maintain constant temperature at 77°±2° F. and humidity is held constant as measured by dew point at 64°±2° F. The quench cabinet is open to the spinning area on the front side. To the bottom of the quench cabinet is connected a quench tube which has an expanded end near the quench cabinet but narrows to dual rectangular sections with rounded ends (each approximately 6⅜" and 15¾"). The quench tube plus cabinet is 16 feet in length. Air temperatures in the quench section are plotted as a function of distance from the spinneret.

The take-up section of the melt spinning system consists of dual ceramic kiss roll lubricant applicators, two Godet rolls and a parallel package winder (Barmag SW4). The yarn is guided from the exit of the quench tube across the lubricant rolls. The RPM of the lubricant rolls is set at 32 RPM to achieve the desired level of one percent lubricant on the as-spun yarn. The lubricant is composed of 95 weight percent UCON-50HB-5100 (ethoxylated propoxylated butyl alcohol [viscosity 5100 Saybolt sec]), 2 weight percent sodium dodecyl benzene sulfonate and 3 weight percent POE5 lauryl potassium phosphate. From the lubricant applicators the yarn passes under the bottom half of the pull-out Godet and over the top half of the second Godet, both operating at a surface speed of 3014 meters/minute and thence to the winder. The Godet rolls are 0.5 m. in circumference and their speed is inverter controlled. The drive roll of the surface-driven winder (Barmag) is set such that the yarn tension between the last Godet roll and the winder is maintained at 0.1–0.2 grams/denier. The traverse speed of the winder is adjusted to achieve an acceptable package build. The as-spun yarn is wound on paper tubes which are 75 mm. inside diameter by 290 mm. long.

The invention has been described in detail with particular reference to certain preferred embodiments thereof but it will be understood that variations and modifications can be effected within the spirit and scope of the invention.

I claim:

1. A filament comprising a central body section and having a first and second pair of wing members extending from and along the length of said continuous body section, said first pair of wing members projecting from one side of said body section and said second pair of wing members projecting from the opposite side of said body section, said central body comprising about 15% to about 60% of the total mass of the filament and said wing members comprising about 85% to about 40% of the total mass of said filament, said filament further having first peripheral concave surfaces between the wing members of each pair of wing members and second peripheral concave surfaces between each pair of wing members.

2. A continuous filament as defined by claim 1 and wheren the wing members of each said pair of wing members diverge away from each other.

3. A continuous filament as defined by claim 1 and wherein the wing members of each said pair of wing members converge toward each other.

4. A continuous filament as defined by claim 1 wherein each of said second peripheral surfaces includes concave surfaces that are smaller than said first concave surface.

* * * * *